US007117544B2

(12) United States Patent
Kanitz

(10) Patent No.: US 7,117,544 B2
(45) Date of Patent: Oct. 10, 2006

(54) ARTICLE OF HEADWEAR

(76) Inventor: Victoria Ann Kanitz, 6621 Wakefield Dr., Unit 416, Alexandria, VA (US) 22307

( * ) Notice: Subject to any disclaimer, the term of this patent is extended or adjusted under 35 U.S.C. 154(b) by 244 days.

(21) Appl. No.: 10/775,087

(22) Filed: Feb. 11, 2004

(65) Prior Publication Data

US 2004/0181851 A1 Sep. 23, 2004

Related U.S. Application Data

(60) Provisional application No. 60/446,556, filed on Feb. 12, 2003.

(51) Int. Cl.
*A42B 5/00* (2006.01)

(52) U.S. Cl. ..... 2/207; 2/209; 2/209.1; 2/172

(58) Field of Classification Search ..... 2/209, 2/209.11, 207, 172; D2/500, 876, 881; 132/273, 132/223
See application file for complete search history.

(56) References Cited

U.S. PATENT DOCUMENTS

| | | | | | |
|---|---|---|---|---|---|
| 58,944 | A | | 10/1866 | Hurlbut | |
| 108,757 | A | | 11/1870 | Case | |
| 145,977 | A | * | 12/1873 | Tuttle | 2/202 |
| 276,720 | A | | 5/1883 | Seiler | |
| 975,582 | A | | 11/1910 | Swindell | |
| 1,040,461 | A | | 10/1912 | Thorpe | |
| 1,179,473 | A | | 4/1916 | Taylor | |
| 1,326,875 | A | | 12/1919 | Miller | |
| 1,503,537 | A | | 8/1924 | Knopf | |
| 1,512,128 | A | | 10/1924 | O'Brien | |
| 1,720,560 | A | | 7/1929 | Lipper | |
| D92,603 | S | * | 6/1934 | James | D2/823 |
| 2,021,144 | A | * | 11/1935 | Beck | 2/174 |
| 2,039,478 | A | * | 5/1936 | Ensten | 2/203 |
| 2,083,616 | A | * | 6/1937 | Rosenberg | 2/203 |
| 2,109,248 | A | | 2/1938 | Hibshman | |
| 2,405,326 | A | | 8/1946 | Plotsky | |
| 2,420,378 | A | | 5/1947 | Lehman et al. | |
| 2,462,727 | A | * | 2/1949 | Danelz | 2/91 |
| 2,464,007 | A | | 3/1949 | Towle | |
| 2,665,427 | A | | 1/1954 | Street et al. | |
| 2,735,283 | A | | 2/1956 | Schuessler | |
| 2,741,773 | A | * | 4/1956 | Wolfe | 2/207 |
| 2,831,197 | A | | 4/1958 | Spells | |
| 3,060,449 | A | | 10/1962 | Lehnhard | |
| 3,088,119 | A | * | 5/1963 | Grant | 2/207 |
| 3,242,501 | A | | 3/1966 | Lish | |
| 3,509,580 | A | | 5/1970 | Rubenstein et al. | |
| 3,668,707 | A | * | 6/1972 | Williams | 2/207 |
| 3,740,767 | A | | 6/1973 | Schuessler | |
| 3,935,567 | A | * | 1/1976 | Reynolds | 340/527 |

(Continued)

*Primary Examiner*—John J. Calvert
*Assistant Examiner*—Richale L. Haney

(57) ABSTRACT

There is provided an article of headwear to be worn over the head and ears of the individual encircling around the circumference of the individual's neck, and extending down a portion of the individual's chest. The article is formed by connecting two, generally double layered strips of fabric. The upper portion gradually increases in diameter to below the ears, with the diameter being thickest at the spaced points of attachment to the lower portion creating a central opening at the back of the individual's head. The lower portion gradually decreases on both ends and is used to secure the device through a passage way or a wrap method. The article provides protection and warmth to the covered areas and fulfills the function of a headband, ear warmer and scarf with one device.

25 Claims, 2 Drawing Sheets

U.S. PATENT DOCUMENTS

| | | | | |
|---|---|---|---|---|
| 3,935,597 | A | | 2/1976 | Frechmann et al. |
| 3,968,521 | A | | 7/1976 | Bashlow |
| 4,110,846 | A | | 9/1978 | Hernandez |
| 4,404,688 | A | | 9/1983 | Knight |
| 4,641,380 | A | | 2/1987 | Epstein |
| 4,654,897 | A | * | 4/1987 | Rosaen ..... 2/207 |
| D293,733 | S | | 1/1988 | Leinoff |
| 4,776,044 | A | | 10/1988 | Makins |
| 4,790,035 | A | | 12/1988 | Whyte |
| 4,870,707 | A | | 10/1989 | Hayes |
| 4,951,319 | A | | 8/1990 | Phillips, Jr. et al. |
| 5,007,115 | A | | 4/1991 | Denbow et al. |
| 5,025,508 | A | | 6/1991 | Duncan |
| 5,038,412 | A | | 8/1991 | Cionni |
| 5,115,517 | A | | 5/1992 | Ferguson et al. |
| 5,144,696 | A | * | 9/1992 | Kahl ..... 2/207 |
| 5,233,704 | A | | 8/1993 | Booher |
| 5,621,920 | A | | 4/1997 | Gorsuch et al. |
| D396,338 | S | * | 7/1998 | Yang ..... D2/500 |
| 5,835,609 | A | | 11/1998 | LeGette et al. |
| 5,987,647 | A | | 11/1999 | Ouellette |
| 6,065,156 | A | * | 5/2000 | Murphy ..... 2/207 |
| 6,185,749 | B1 | * | 2/2001 | Williams ..... 2/209.13 |
| 6,401,255 | B1 | | 6/2002 | Douglas |
| 6,640,342 | B1 | | 11/2003 | Dixon |

* cited by examiner

ARTICLE OF HEADWEAR

CROSS-REFERENCE TO RELATED APPLICATIONS

The present Application for Patent claims priority to Provisional Application No. 60/446,556, entitled "Article of Headwear," filed Feb. 12, 2003, and hereby expressly incorporated by reference herein.

STATEMENT REGARDING FEDERALLY SPONSORED RESEARCH OR DEVELOPMENT

NA

REFERENCE TO SEQUENCE LISTING, A TABLE, OR A COMPUTER PROGRAM LISTING COMPACT DISC APPENDIX

NA

BACKGROUND OF THE INVENTION

The described embodiments relate to a covering device, specifically to a garment that may function as a scarf and a head band combination, along with a method of using the covering device.

There are a numerous warming devices for use as head, ear, neck and chest protectors. These devices are represented in part by: U.S. Pat. No. 1,040,461 to Thorpe, which discloses a cap and hood which also covers the neck; U.S. Pat. No. 2,735,283 to Schuessler, which discloses a knitted cap structure with multiple means of attachment; U.S. Pat. No. 3,509,580 to Rubenstein et al., which discloses a multipurpose dress accessory that may be worn numerous ways; U.S. Pat. No. 3,935,597 to Frechmann et al., which discloses a wearing apparel hood which covers the head, front of the neck and a portion of the chest; U.S. Pat. No. 5,038,412 to Cionni, which discloses a headband with earmuffs; U.S. Pat. No. 5,115,517 to Ferguson, et al., which discloses a scarf garment which covers the head, ears and neck; U.S. Pat. No. 6,640,342 to Dixon, which discloses a hat and scarf combination which covers the head, ears, neck and chest area. However, more comfortable covering devices that provide less disruption of the hair are desired.

Although there are various types of ear and neck warmers the present invention has been constructed to protect the ears in a comfortable manner without applying pressure on the head and the ears. The headband like shape results in less disruption of the hair and focuses on the ears, neck and a portion of the chest area, allowing men, women and children an alternative method for warmth. The button hole and the alternate attachment device such as Velcro or any other attachment devices are strategically placed in positions that enable the present invention to be reversible and remain secure during most activities. A conventional hat may be worn over the present invention and the compact and flexible nature allows it to fit in a pocket.

BRIEF SUMMARY OF THE INVENTION

The described embodiments include improved articles of headwear, and methods of making and using articles of headwear.

In one embodiment, an article of headwear comprises a first fabric member configured to cover at least a portion of a neck of a person and a second fabric member configured to cover at least a portion of a head of the person. The first fabric member extends between a first end and a second end and has a first intermediate portion between the first end and the second end. The second fabric member extends between a third end and a fourth end. Further, the third end and the fourth end are both attachable to the first intermediate portion so as to define a rearward opening, wherein the rearward opening is sized to accept a rear portion of the head of the person In another embodiment, an article of headwear comprises a scarf member and a band member. The scarf member comprises a first intermediate portion that extends between a first end portion and a second end portion. The band member comprises a second intermediate portion that extends between a third end portion and a fourth end portion. Further, the third end portion and the fourth end portion are respectively attachable to the scarf member. Additionally, the band member further comprises a first edge opposing a second edge, where the first edge and the second edge each extend from the third end portion across the second intermediate portion to the fourth end portion. Further, the first edge has a first length and the second edge has a second length, where the first length is greater than the second length.

In yet another embodiment, an article of headwear comprises a first means for covering at least a portion of a neck of a person and a second means for covering at least a portion of each ear of the person without covering at least a predetermined rear portion of a head of the person. Further, the predetermined rear portion lies between the second means and the first means. Additionally, the second means is connectable to the first means.

In still another embodiment, the described embodiments relate to a covering device connected in a novel way which allows the device to adjust to the contour of an individual's proportions. The device includes a head band connected to a scarf portion. The head band has a relatively narrow width at the top portion of the head and gradually widens to a relatively wider width that covers an individual's ears. The headband includes angled ends and is attached to the scarf portion at spaced points resulting in the covering device having an opening at the back of the head. The scarf portion may include a button hole type opening at one end through which the other end may be inserted, which enables the scarf to adjust to most sizes and to extend downward to cover a portion of the chest. The scarf portion can also be connected by an attachment placed at each opposite end portion, where in one embodiment the chest covering portion does not exist.

Additional aspects and advantages of the disclosed embodiments are set forth in part in the description which follows, and in part are obvious from the description, or may be learned by practice of the disclosed embodiments. The aspects and advantages of the disclosed embodiments may also be realized and attained by the means of the instrumentalities and combinations particularly pointed out in the appended claims.

BRIEF DESCRIPTION OF THE SEVERAL VIEWS OF THE DRAWINGS

The disclosed embodiments will hereinafter be described in conjunction with the appended drawings provided to illustrate and not to limit the disclosed embodiments, wherein like designations denote like elements, and in which.

DETAILED DESCRIPTION OF THE INVENTION

Figure 1:
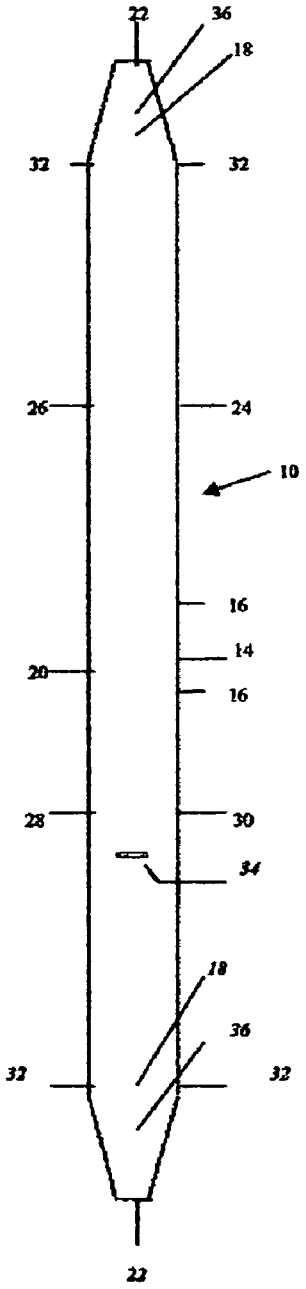
FIG. 1 is a top plan view of one embodiment of a scarf portion of a covering device.

Referring in detailed description to the drawings, FIG. 1 shows a neck and chest covering device generally designated by the numeral 10. The neck and chest covering device 10, is formed by an elongated fabric member of a generally rectangular configuration having an intermediate portion 14, spaced points portions 16, a front portion 18, a back portion 20, opposite end portions 22, a top portion 24, a bottom portion 26, opposite side edges 28 and 30, beginning of reduced opposite end portions 32, buttonhole portion 34, and an alternate attachment portion 36.

Figure 2:
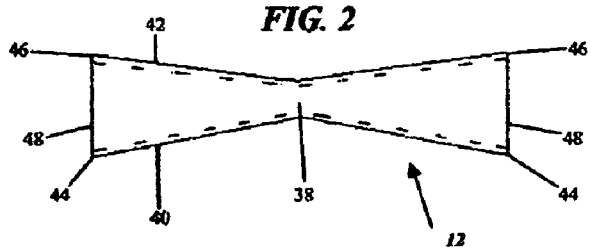
FIG. 2 is a top plan view of one embodiment of a headband portion of a covering device.

Referring to FIG. 2, there is provided an elongated strip of fabric in which identical parts are identified with the same reference numeral. The head band portion shown in FIG. 2, generally designated by the numeral 12, is formed by a generally hourglass fabric member having an intermediate portion 38, opposite side edges 40 and 42, a front edge 44, a back edge 46, an opposite end portions 48. The fabric members of 12 are joined together by a respective pair of first and second fabric layers. In the illustrated structure 12, each of the fabric portions 44 and 46 are secured together by a line of stitching along the interior of 40 and 42. The width of the intermediate portion 38 is substantially less than the width of fabric portions 44, 46 and 48. Also referring to 12, fabric members are then turned so as a line of stitching 50 is applied to the exterior of fabric portions 12 to secure the elongated hourglass configuration. The length of 44 is preferably in the range of 9⅜", whereas the length of 46 is preferably in the range of 9⅞".

The fabric member 12 is placed into the interior of member 10 (FIG. 1) at the top portion 24 and at the opposite side edge 30, with each back edge 46 of member 12, respectively placed at one of points 16 (FIG. 1), whereby member 10 of FIG. 1 and member 12 of FIG. 2 are joined together with a singly seam leaving an opening of approximately 1" for turning to expose the exterior of the completed combination. In one embodiment, the distance between the spaced points 16 will equal a space or opening at the back neck portion of the person's head of approximately 2¾". A topstitching is sewn around the complete edges of FIG. 1 reference 10 while also enclosing the 1" opening used for turning. The spaced points 16 of FIG. 1 are affixed slightly off center which aids in the unique fit of the headwear. This connection defines an attached scarf and headband.

A buttonhole is applied FIG. 1 reference 34 at the center of 28 and 30 approximately 2" from both points 16 to provide a point of attachment. The button hole is a form of attachment so as the wearer has control over the tightness desired whereas the length permits the scarf portion 10 to extend over the chest and worn under the collar and opening of the wear's coat. When FIG. 1 opposite end portions 22 are inserted into buttonhole 34 the opposite end portions will cross at the neck area and extend downward to the chest. This method prevents wind and cold from entering into the exposed area some coats do not protect. The various dimensions of 10 allow resistance when inserted into 34, so as the attachment is secure although flexible, and most important adjust to most sizes.

Figure 3:
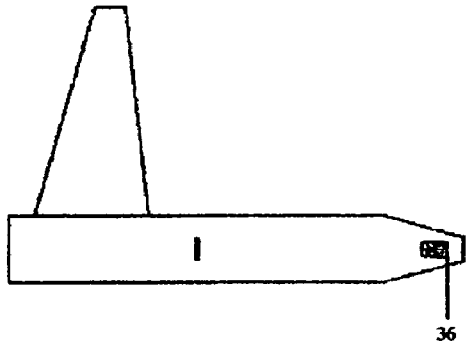
FIG. 3 is a left side view of one embodiment of the covering device.

The combination of the scarf portion and the neck and chest covering device is shown in FIG. 3, with reference to the alternate attachment method 36. A fastening device such as but not limited to Velcro, is mounted to FIG. 1, alternate attachment 36. This method results in the scarf portion extending only around the individual's neck as opposed to the chest covering portion which is described in 34.

Figure 4:
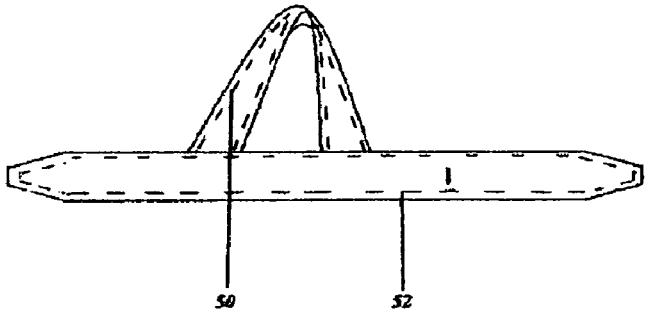
FIG. 4 is a back side view of one embodiment of the covering device.

FIG. 4 shows the completed device with reference to the top stitching 50 and 52.

Figure 5:
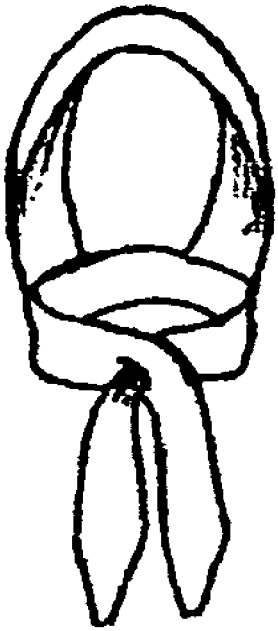
FIG. 5 is a front, perspective of one embodiment of a covering device, including attaching the scarf portion by insertion through a passageway.

FIG. 5 shows the combined FIG. 1 and FIG. 2 portions functioning as a headband, ear, neck and chest covering device.

Figure 6:
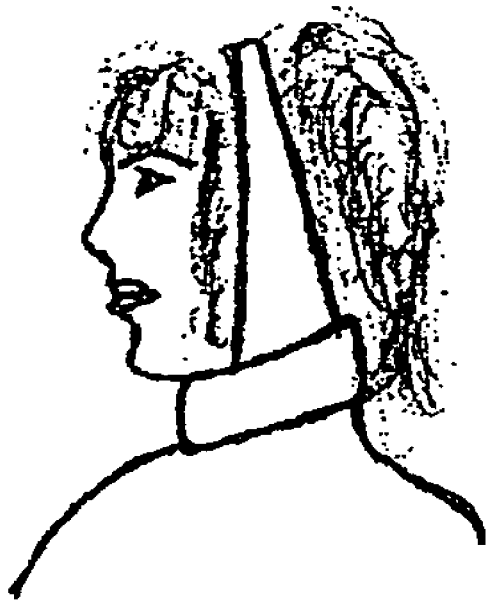
FIG. 6 is a side view of an embodiment of a covering device being worn by an individual, including another scarf portion attachment mechanism.

FIG. 6 shows the combined FIG. 1 and FIG. 2 portions functioning as a headband and neck covering device.

Although there are various types of ear and neck warmers the present invention has been constructed to protect the ears in a comfortable manner without applying pressure on the head and the ears. The headband like shape results in less disruption of the hair and focuses on the ears, neck and a portion of the chest area, allowing men, women and children an alternative method for warmth. The button hole and the alternate attachment device such as Velcro or any other attachment devices are strategically placed in positions that enable the present invention to he reversible and remain secure during most activities. A conventional hat may be worn over the present invention and the compact and flexible nature allows it to fit in a pocket.

The foregoing description has made apparent preferred embodiments of this invention. Variations and modifications may be made within the scope, the spirit, or the essential attributes of this invention therefore, reference should not be limited to the specific disclosures but only by the appending claims.

I claim:

1. An article of headwear, comprising:

a first fabric member configured to cover at least a portion of a neck of a person, the first fabric member extending between a first end and a second end and having a first intermediate portion between the first end and the second end; and a second fabric member configured to cover at least a portion of a head of the person, the second fabric member extending between a third end and a fourth end, wherein the third end and the fourth end are both attached to the first intermediate portion so as to define a first opening and an opposing second opening between the first fabric member and the second fabric member, wherein the first-opening is configured to expose a face of the person, and wherein the second opening is further defined by an upper edge of the first intermediate portion and is configured to expose a rear portion of the head of the person.

2. The article of headwear of claim 1, wherein the third end and the fourth end are both attached to the first intermediate portion in a predetermined, spaced apart relationship.

3. The article of headwear of claim 1, wherein the second fabric member further comprises a second intermediate portion between the third end and the fourth end, and a first side edge opposing a second side edge, wherein a first width of the second intermediate portion is less than a second width adjacent the third end and the fourth end, wherein the first width and the second width extend between the first side edge and the second side edge.

4. The article of headwear of claim 1, wherein the second fabric member further comprises a first side edge opposing a second side edge, the first side edge having a first length and the second side edge having a second length, wherein the first length is greater than the second length.

5. The article of headwear of claim 4, wherein the second side edge faces the first intermediate portion of the first fabric member.

6. The article of headwear of claim 1, further comprising an attachment mechanism for attaching a first portion of the first fabric member to a second portion of the first fabric member.

7. The article of headwear of claim 6, wherein the attachment mechanism comprises an inner portion defining a hole formed on the first fabric member, the hole sized to receive one of the first end and the second end.

8. The article of headwear of claim 2, wherein the spaced apart relationship between the third end and the fourth end attached to the first fabric member is configured such that, when in use, the second fabric member extends from a top of the head of the person to cover at least a portion of each ear of the person.

9. The article of headwear of claim 2, wherein the first fabric member extends along a first longitudinal axis, wherein the second fabric member extends along a second longitudinal axis, and wherein the second longitudinal axis is disposed at a predetermined oblique angle relative to the first longitudinal axis at the attachment between the first fabric member and the second fabric member.

10. The article of headwear of claim 1, wherein at least one of the first fabric member and the second fabric member comprises a first fabric layer connected to a second fabric layer.

11. The article of headwear of claim 1, wherein a first distance from the third end to the nearest one of the first end and the second end is substantially unequal to a second distance from the fourth end to the other one of the first end and the second end.

12. An article of headwear, comprising:

a scarf member comprising a first intermediate portion extending between a first end portion and a second end portion; and a band member comprising a second intermediate portion extending between a third end portion and a fourth end portion, the third end portion and the fourth end portion respectively attached to the scarf member, the band member further comprising a first edge opposing a second edge, the first edge and the second edge each extending from the third end portion across the second intermediate portion to the fourth end portion, the first edge having a first length and the second edge having a second length, wherein the first length is greater than the second length, wherein the first edge of the band member and the first end portion second end portion of the scarf member define a first opening, and wherein the second edge of the band member and the first intermediate portion of the scarf member define a second opening substantially opposing the first opening.

13. The article of headwear of claim 12, wherein the first intermediate portion comprises a first position at a predetermined spacing from a second position, wherein the third end portion is attached to the first intermediate portion at the first position and the fourth end portion is attached to the first intermediate portion at the second position such that the second intermediate portion is unattached to the first intermediate portion.

14. The article of headwear of claim 12, wherein the scarf member extends along a first longitudinal axis, wherein the band member extends along a second longitudinal axis, and wherein the second longitudinal axis is disposed at a predetermined oblique angle relative to the first longitudinal axis at the attachment between the scarf member, and the band member.

15. The article of headwear of claim 12, wherein the first intermediate portion is configured to cover a back of a neck of a person.

16. The article of headwear of claim 12, wherein the predetermined spacing is arranged such that, when in use, the band extends over a top portion of a head of a person and covers at least a portion of each ear of the person.

17. The article of headwear of claim 12, wherein each of the third end and the fourth end have a first width extending between the first edge and the second edge, wherein the first width is sized to cover at least a portion of an ear of a person wearing the article of headwear.

18. The article of headwear of claim 12, wherein the second intermediate portion has a first width extending between the first edge and the second edge, wherein each of the third end portion and the fourth end portion have a second width extending between the first edge and the second edge, and wherein the first width is less than the second width.

19. The article of headwear of claim 12, further comprising an attachment mechanism for attaching a first portion of the scarf member to a second portion of the scarf member.

20. The article of headwear of claim 12, wherein the attachment mechanism comprises an inner portion defining a hole formed on the scarf member, the hole sized to receive one of the first end portion and the second end portion.

21. The article of headwear of claim 12, wherein at least one of the scarf member and the band member comprises a first fabric layer connected to a second fabric layer.

22. An article of headwear, comprising:

a first means having a first portion sized to cover at least a rear portion and a side portion of a neck of a person;

a second means having a second portion and a third portion respectively connected to the first means at attachment positions separated by a predetermined spacing along at least a part of the first portion of the first means so as to define a first opening and an opposing second opening between the first means and the second means; and wherein the second portion and the third portion are adjoined so as to define a shared rear edge, wherein the rear edge is positioned adjacent to the first portion of the first means at each of the attachment positions, wherein the rear edge and the part of the first portion corresponding to the predetermined spacing define the second opening between the first means and the second means.

23. An article of headwear, comprising:

a first fabric member extending along a longitudinal axis between a first end and a second end, the first fabric member having a first intermediate portion between the first end and the second end; and a second fabric member defined by a first side edge opposing a second side edge extending between a third end and a fourth end, wherein the third end and the fourth end are both attached to the first intermediate portion such that the first side edge and the first end and the second end of the first fabric member define a first opening, and such that the second side edge and the intermediate portion of the first fabric member define a second opening opposing the first opening wherein the second opening is sized to expose a rear portion of a head of a person, and wherein the first side edge is disposed at a predetermined oblique angle at the point of attachment to the first fabric member, the predetermined oblique angle being relative to the longitudinal axis of the first fabric member.

24. The article of headwear of claim 23, wherein the predetermined oblique angle comprises an angle greater than about 90 degrees.

25. The article of headwear of claim 23, wherein the third end and the fourth end are both attached to the first intermediate portion in a predetermined, spaced apart relationship.

* * * * *